US008448804B2

(12) United States Patent
Luburic

(10) Patent No.: US 8,448,804 B2
(45) Date of Patent: May 28, 2013

(54) PIVOTING COVER WITH A FASTENING DEVICE

(75) Inventor: Frano Luburic, Anaheim, CA (US)

(73) Assignee: Ropak Corporation, Fountain Valley, CA (US)

( * ) Notice: Subject to any disclaimer, the term of this patent is extended or adjusted under 35 U.S.C. 154(b) by 1266 days.

(21) Appl. No.: 11/538,773

(22) Filed: Oct. 4, 2006

(65) Prior Publication Data

US 2008/0083768 A1 Apr. 10, 2008

(51) Int. Cl.

| | |
|---|---|
| ***B65D 17/34*** | (2006.01) |
| ***B65D 43/14*** | (2006.01) |
| ***B65D 51/04*** | (2006.01) |
| ***B65D 43/24*** | (2006.01) |
| ***B65D 43/16*** | (2006.01) |
| ***B65D 39/00*** | (2006.01) |
| ***B65D 41/00*** | (2006.01) |
| ***B65D 43/00*** | (2006.01) |
| ***B65D 47/00*** | (2006.01) |
| ***B65D 51/00*** | (2006.01) |

(52) U.S. Cl.

USPC ..... 220/270; 220/810; 220/831; 220/832; 215/254; 229/123.3

(58) Field of Classification Search

USPC . 220/270, 810, 831, 832; 215/254; 229/123.3
See application file for complete search history.

(56) References Cited

U.S. PATENT DOCUMENTS

| | | | | |
|---|---|---|---|---|
| 4,790,448 | A * | 12/1988 | Ostrum et al. | 220/270 |
| 4,969,572 | A * | 11/1990 | vanKerkhoven et al. | 220/253 |
| 5,111,961 | A * | 5/1992 | Van Melle | 220/712 |
| 5,145,090 | A * | 9/1992 | Wyatt | 220/592.25 |
| 5,249,694 | A * | 10/1993 | Nelson | 220/276 |
| 6,260,727 | B1 * | 7/2001 | Durdon | 220/254.3 |
| 6,412,637 | B1 * | 7/2002 | Saunders et al. | 206/541 |
| 6,471,083 | B1 | 10/2002 | Helms | |
| 6,523,713 | B1 | 2/2003 | Helms | |
| 2004/0149675 | A1 * | 8/2004 | Perry et al. | 215/228 |
| 2005/0072783 | A1 | 4/2005 | Choi | |
| 2005/0145626 | A1 * | 7/2005 | Freek et al. | 220/254.1 |

FOREIGN PATENT DOCUMENTS

WO WO 2004/096650 11/2004

OTHER PUBLICATIONS

International Search Report and Written Opinion from corresponding International Application No. PCT/US06/39081, dated Jul. 3, 2007.

* cited by examiner

*Primary Examiner* — Anthony Stashick
*Assistant Examiner* — Andrew T Kirsch
(74) *Attorney, Agent, or Firm* — Vedder Price P.C.

(57) ABSTRACT

A cover for a container, in accordance with one embodiment that allows quick and easy access to products within the container. The cover for a container includes a pivot score line transversing the cover thereby forming a front cover portion and a back cover portion. The pivot score line pivotally connects the front cover portion and the back cover portion. The cover also includes a fastening device. The fastening device includes a first fastening component mounted on the front cover portion and a second fastening component mounted on the back cover portion. The first fastening component engages the second fastening component upon pivoting the cover at the pivot score line. Using the present embodiment, products may be repeatedly dispensed from a container quickly and easily.

22 Claims, 5 Drawing Sheets

PIVOTING COVER WITH A FASTENING DEVICE

BACKGROUND OF THE INVENTION

Many products requiring covered storage in containers must be repeatedly dispensed from the container. Repeated removal of the entire cover from the container to access the product for dispensing is time consuming and inefficient. Moreover, repeated removal of the entire cover often results in damage to the cover and/or container over time. This damage typically results in unintended exposure of the products to atmospheric elements thereby compromising the product.

Thus, there is a need in the art for a cover that allows for quick and easy access to products within containers for facile dispensing. The present invention provides solutions to these and other problems in the art.

BRIEF SUMMARY OF THE INVENTION

The present invention provides a cover for a container that allows quick and easy access to products within the container. Using the present invention, products may be repeatedly dispensed from the container quickly and easily.

In one aspect, the present invention provides a cover for a container including a pivot score line transversing the cover thereby forming a front cover portion and a back cover portion. The pivot score line pivotally connects the front cover portion and the back cover portion. The cover also includes a fastening device. The fastening device includes a first fastening component mounted on the front cover portion and a second fastening component mounted on the back cover portion. The first fastening component engages the second fastening component upon pivoting the cover at the pivot score line.

In another aspect, the present invention provides a cover for a container including a centrally located web and a removable primary detent connected to the web. The removable primary detent is engageable with a container retaining element present on the container. The cover also includes a secondary detent connected to the web. The secondary detent is engageable with a container retaining element present on said container. The cover further includes a pivot score line transversing the cover thereby forming a front cover portion and a back cover portion. The pivot score line pivotally connects the front cover portion and the back cover portion. The cover also includes a fastening device comprising a first fastening component mounted on the front cover portion and a second fastening component mounted on the back cover portion. The first fastening component engages the second fastening component upon pivoting the cover at the pivot score line.

In another aspect, the present invention provides a cover for a container including a front cover portion pivotally connected to a back cover portion and a means for positioning and holding the front cover portion at a fixed angle relative to the back cover portion. The cover further includes a removable primary means for positioning and holding the cover in operable relationship with the container, and a secondary means for positioning and holding the cover in operable relationship with the container.

DETAILED DESCRIPTION OF THE INVENTION

Figure 1:
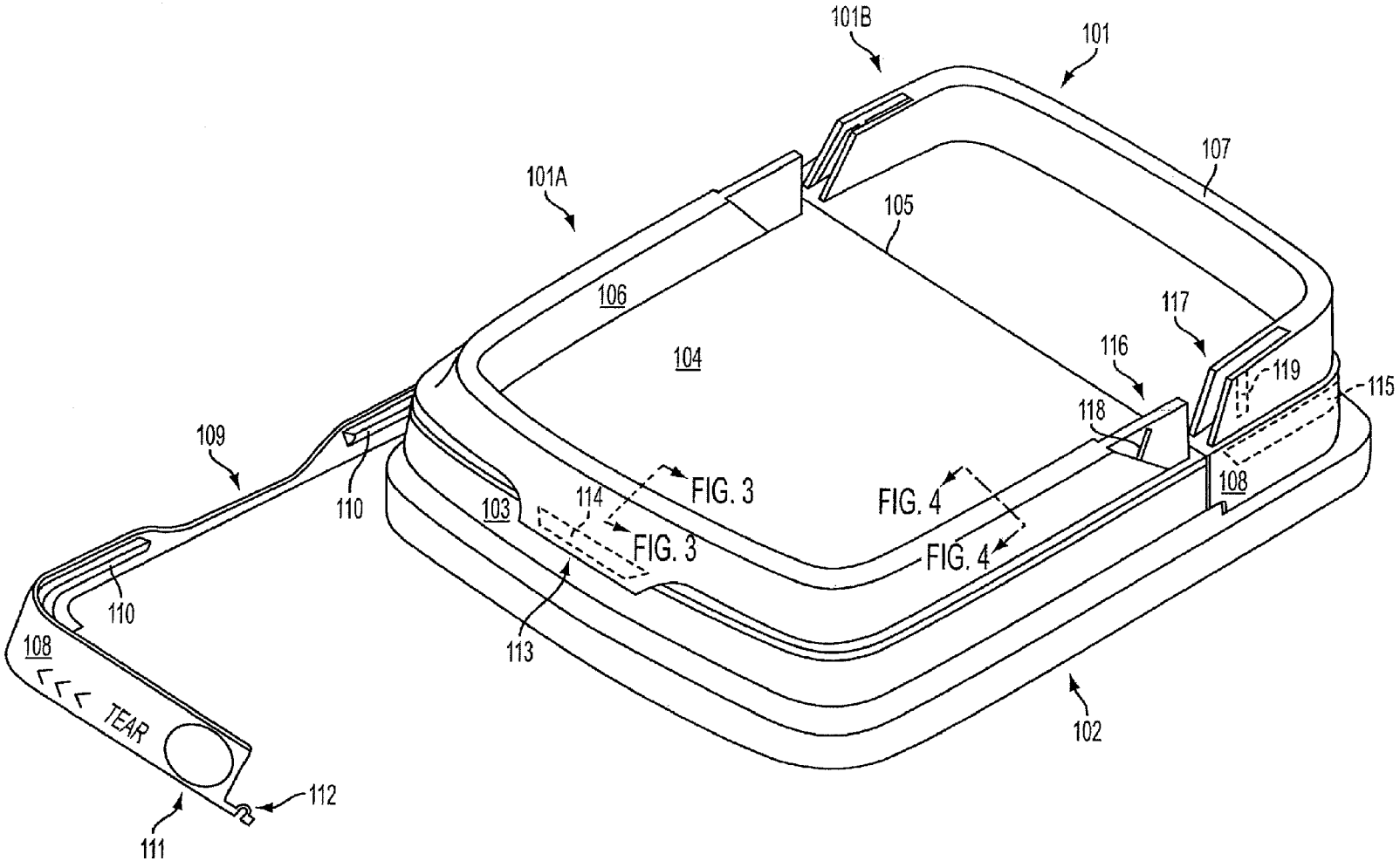
FIG. 1 illustrates a cover of substantially square configuration adapted to be mounted upon the upper extremity of a container and comprising a male fastening component on a front portion of the cover and a female fastening component on a back portion of the cover in accordance with one embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions, sizing, and/or relative placement of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will also be understood that the terms and expressions used herein have the ordinary meaning as is usually accorded to such terms and expressions by those skilled in the corresponding respective areas of inquiry and study except where other specific meanings have otherwise been set forth herein. One embodiment provides a cover for a container including a pivot score line transversing the cover thereby forming a front cover portion and a back cover portion. The pivot score line pivotally connects the front cover portion and the back cover portion. The container also includes a fastening device. The fastening device includes a first fastening component mounted on the front cover portion and a second fastening component mounted on the back cover portion. The first fastening component engages the second fastening component upon pivoting the cover at the pivot score line. The cover may be alone or in combination with the container. The fastening components may be located in various positions on the front cover portion and back cover portion. Generally, however, the fastening components will be located proximate the pivot score line.

In certain embodiments, the cover includes four corners, such as in a substantially square configuration, which provides a space efficient shape. Thus, in some embodiments, the cover includes four corners with substantially straight sides between each of the four corners. The cover may be composed of any appropriate material. In some embodiments, the container is composed of a rigid plastic such as polypropylene (e.g. polypropylene impact copolymer). Alternate embodiments provide for a cover having different shapes, such as, for example, a rectangle, an oval and a circle.

In some embodiments, the cover completely overlays an opening of a container. Upon lifting the front cover portion, the cover will pivot and fold along the pivot score line, thereby exposing a portion of the container opening. Once the front portion cover is sufficiently pivoted (e.g. folded), the first and second fastening components engage, thereby holding the front cover portion in place and allowing access to the contents of the container. Thus, in this embodiment, one may distribute the contents of the container without holding the front cover portion open. Upon completion of the product distribution, one may simply pull the front cover portion to disengage the first and second fastening components. Once disengaged and moved downward back onto the top of the container, the cover will once again completely overlay the opening of the container thereby protecting the product within the container from environmental elements. Thus, in some embodiments, one may conveniently dispense product with one hand, as opposed to two hands, by opening the front cover portion, locking the front cover portion in an open position by engaging (e.g. snapping in place) the first and second fastening components, dispensing the product, and closing the front cover portion by disengaging the first and second fastening components. Thus, the cover may be set to the open position without the use of a tool.

In some embodiments, the first fastening component is a male component mounted on the front cover portion and the second fastening component is a female component mounted on the back cover portion. In other embodiments, the first fastening component is a female component mounted on the front cover portion and the second fastening component is a male component mounted on the back cover portion. The male component may include a tongue and the female component may include a groove. The tongue securely fastens into the groove upon pivoting the cover at the pivot score line. One skilled in the art will immediately recognize that the term "securely fastens" includes embodiments wherein the tongue may be quickly and easily disengaged from the groove so that the cover may completely overlay the opening of the container.

In another aspect, in addition to the fastening device, the present invention may also include a removable primary detent and a secondary detent, both engageable with a container retaining element present on the container. Thus, some embodiments provide a cover for a container including a centrally located web and a removable primary detent connected to the web. The removable primary detent is, for example, part of a tear strip. The removable primary detent is engageable with a container retaining element present on the container. The cover also includes a secondary detent connected to the web. The secondary detent is engageable with a container retaining element present on the container. The cover further includes a pivot score line transversing the cover thereby forming a front cover portion and a back cover portion. The pivot score line pivotally connects the front cover portion and the back cover portion. The cover also includes a fastening device comprising a first fastening component mounted on the front cover portion and a second fastening component mounted on the back cover portion. The first fastening component engages the second fastening component upon pivoting (e.g. folding) the cover at the pivot score line.

In some embodiments, the first fastening component and the second fastening component are positioned adjacent to the pivot score line. The first fastening component and the second fastening component may form a male-female complementary fastening pair. The cover may include four corners. Between the four corners, the sides may be substantially straight. The secondary detent may be peripherally spaced from one of the corners. The cover may include a tab member peripherally spaced from one of the corners, where the secondary detent is mounted within the tab member. The cover may include a plurality of secondary detents. As discussed above, the cover may be composed of a rigid plastic such as polypropylene. The cover may also be in combination with the container.

The removable primary detent and the secondary detent serve to affix the cover to the container via the container retaining element on the container. The removable primary detent may serve as tamper-evidency to protect the product within the container (e.g. a tear strip). That is, the absence (or partial removal) of the removable primary detent evidences tampering of the cover and possible prior access to the product. Where the removable primary detent is absent, the cover may remain permanently affixed to the container through the secondary detent and/or additional detents (e.g. an additional detent affixing the back cover portion to the container, herein referred to as a back cover portion detent). Thus, in some embodiments, the removable primary detent and the secondary detent are connected to the front cover portion. A back cover portion detent engageable with a container retaining element may be connected to the back cover portion through the centrally located web. In this embodiment, the cover may be attached to the container via the secondary detent and the back cover portion detent where the removable primary detent is absent. And where the front cover portion is in the open position, the cover remains attached to the container via the back cover portion detent. In this way, the cover may remain affixed to the container even during dispensing thereby limiting contamination of product within the container.

Useful embodiments of removable primary detents and secondary detents are explained in detail, for example, in U.S. Pat. No. 5,617,968 (referred to therein as "primary detent means" and "secondary detent mean," respectively).

The removable primary detent may also be referred to herein as a removable first means for positioning and holding the cover. The secondary detent may also be referred to herein as a second means for positioning and holding the cover. For example, in some embodiments the present invention provides a cover for a container including a front cover portion pivotally connected to a back cover portion and a means for positioning and holding the front cover portion at a fixed angle relative to the back cover portion. The cover further includes a removable primary means for positioning and holding the cover in operable relationship with the container, and a secondary means for positioning and holding the cover in operable relationship with the container.

Figure 6:
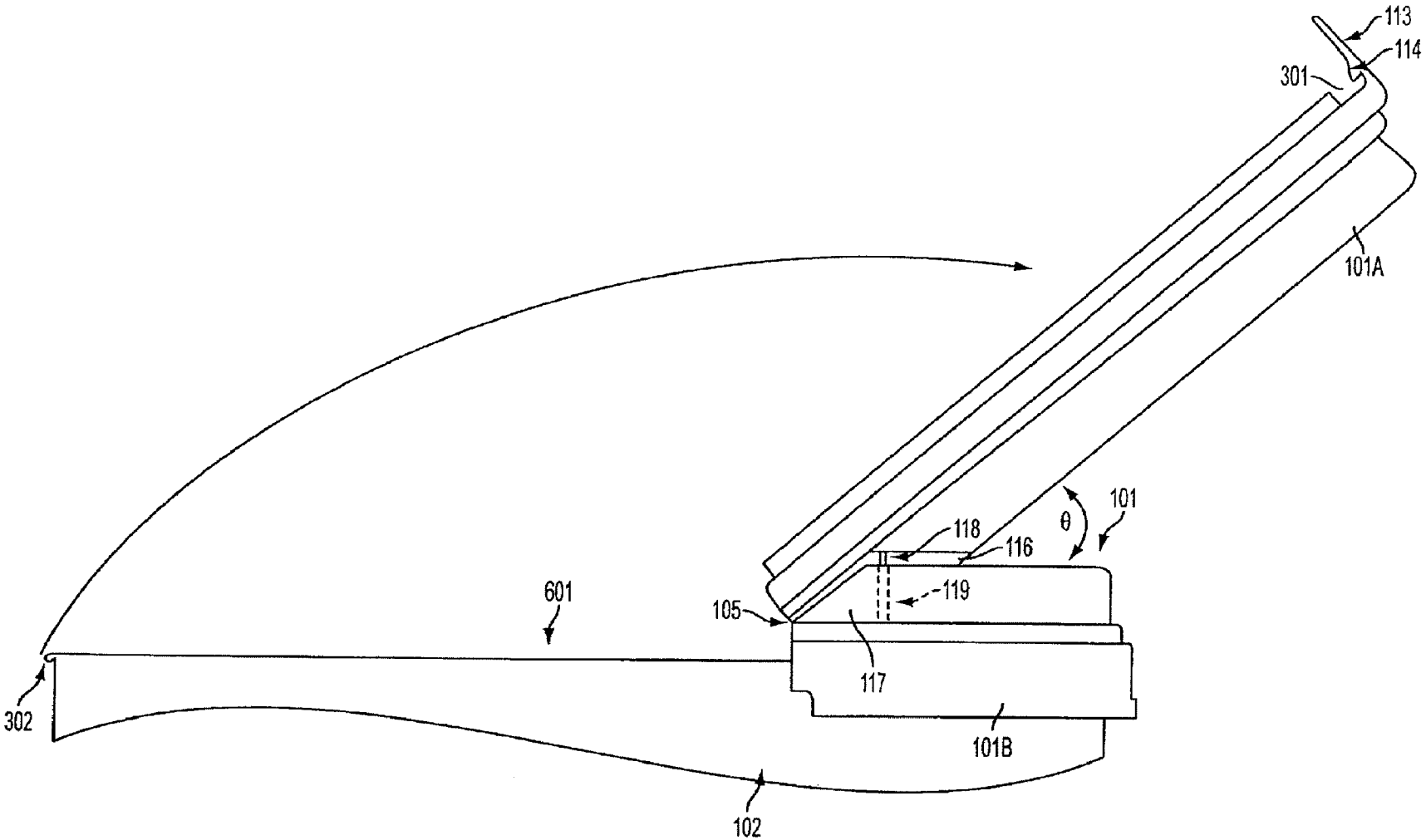
FIG. 6 illustrates a front portion of a cover pivoting at a score line, thereby exposing an open portion of a container and engaging a fastening component on the front portion of the cover with a fastening component on the back portion of the cover in accordance with one embodiment.

The fixed angle is the angle between the front cover portion and the back cover portion, as exemplified in FIG. 6. In some embodiments, the fixed angle is ninety degrees or less. As in other aspects described above, the cover may include four corners (e.g. with substantially straight sides between each of said four corners); the secondary means may be peripherally spaced from one of the corners (e.g. a tab member peripherally spaced from one of the corners where the secondary means is mounted within the tab member); the cover may be composed of a rigid plastic (e.g. polypropylene); and the cover may be in combination with the container.

Further embodiments of the invention and details thereof will be apparent from the drawings, which are described in detail below. The Figures and descriptions thereof are for the purpose of clarifying certain embodiments of the invention, and are not meant to limit the scope of the invention.

Figure 2:
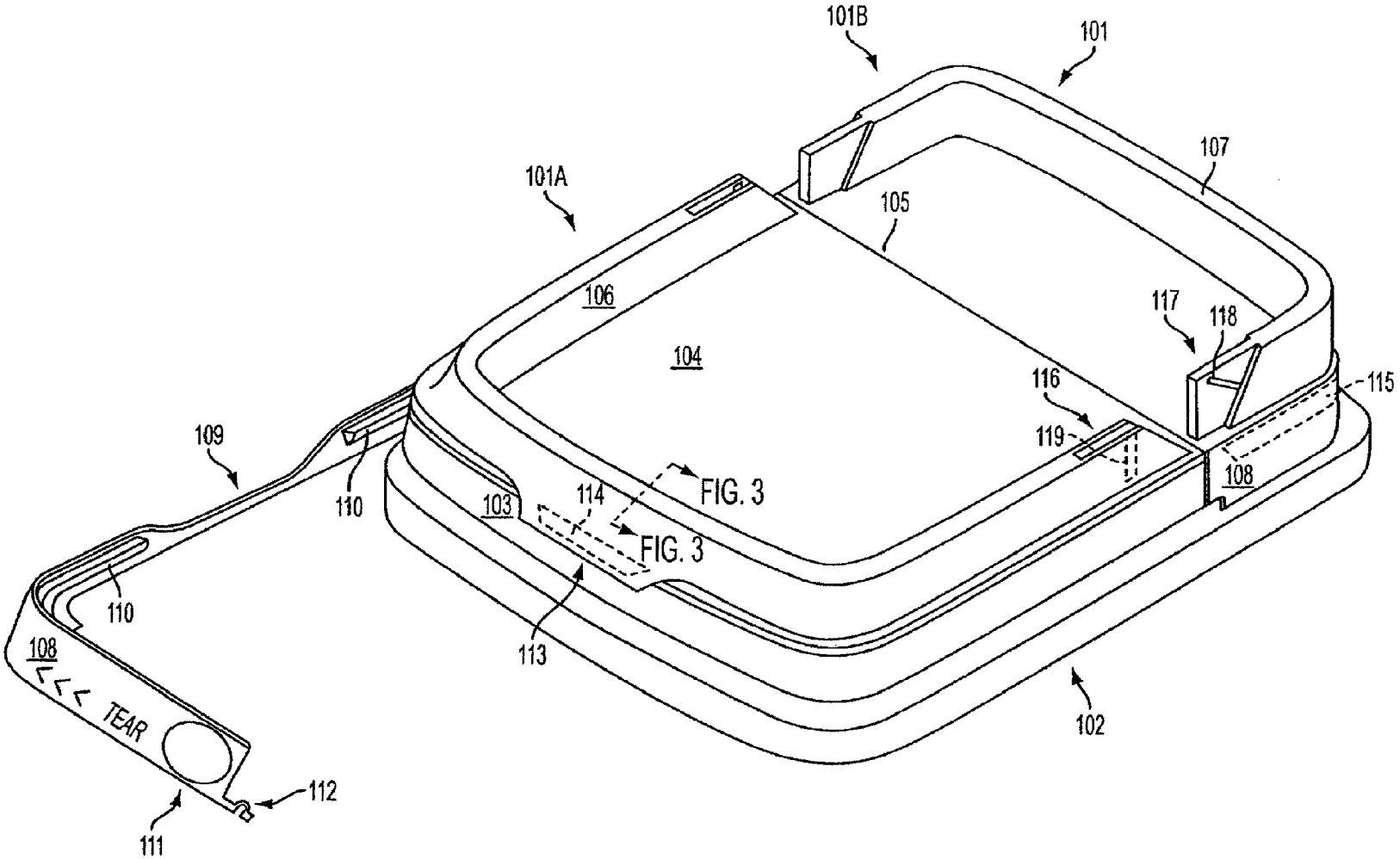
FIG. 2 shows a cover of substantially square configuration adapted to be mounted upon the upper extremity of a container and comprising a female fastening component on a front portion of the cover, and a male fastening component on a back portion of the cover in accordance with one embodiment.

FIGS. 1 and 2, in accordance with one embodiment, show a cover 101 of substantially square configuration adapted to be mounted upon the upper extremity 103 of a container 102, the container 102 being of correspondingly square configuration to the cover 101. It should be understood that alternate shapes for the lid may also incorporate the features of the embodiments described herein. For example, rectangular, circular, and oval lids are utilized in alternate embodiments. The container 102 and cover 101 may be fabricated from synthetic plastic (e.g. polypropylene) or other suitable materials such as aluminum. The cover 101 may be fabricated from polypropylene by injection molding. The cover of FIGS. 1 and 2 includes a centrally located web 104 having a pivot score line 105. The pivot score line 105 transverses the cover 101 thereby forming a front cover portion 101A and a back cover portion 101B.

Formed integrally with the web 104 is a vertical wall 106 connected to a horizontal flange 107 incorporating a depending external skirt 108 which encompasses the upper extremity of the container 102. The upper extremity 103 fits within the substantially U-shaped cavity 301 defined between the vertical wall 106, horizontal flange 107, and depending external skirt 108, as most clearly shown in FIGS. 3 and 4.

Figure 4:
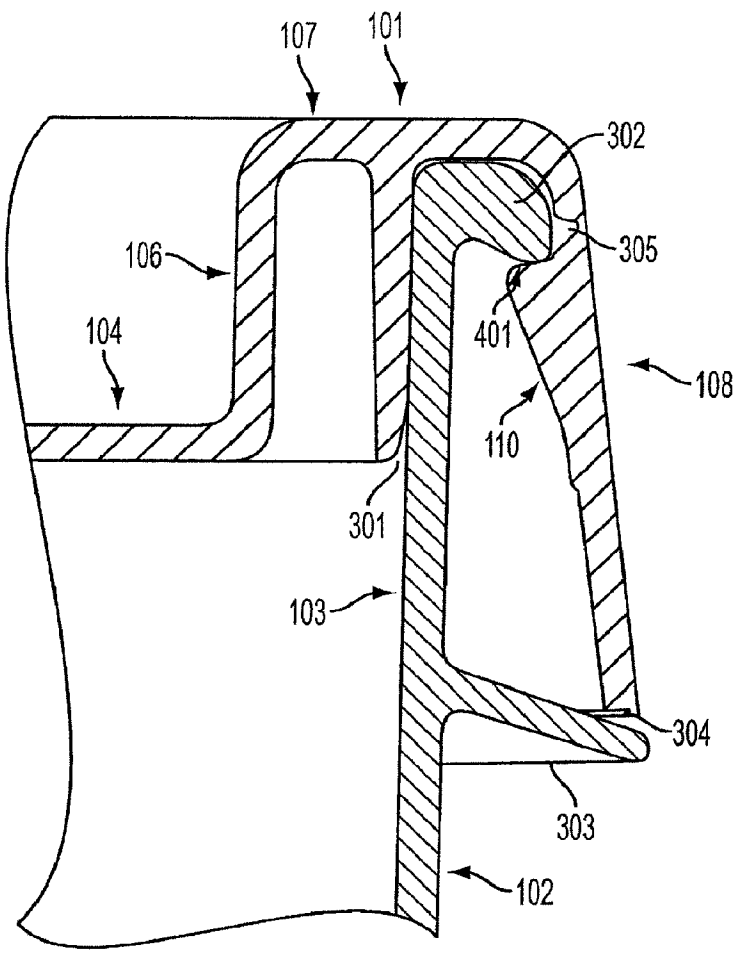
FIG. 4 shows a sectional view of a cover and container taken on the broken line 4-4 of FIG. 1.
Figure 3:
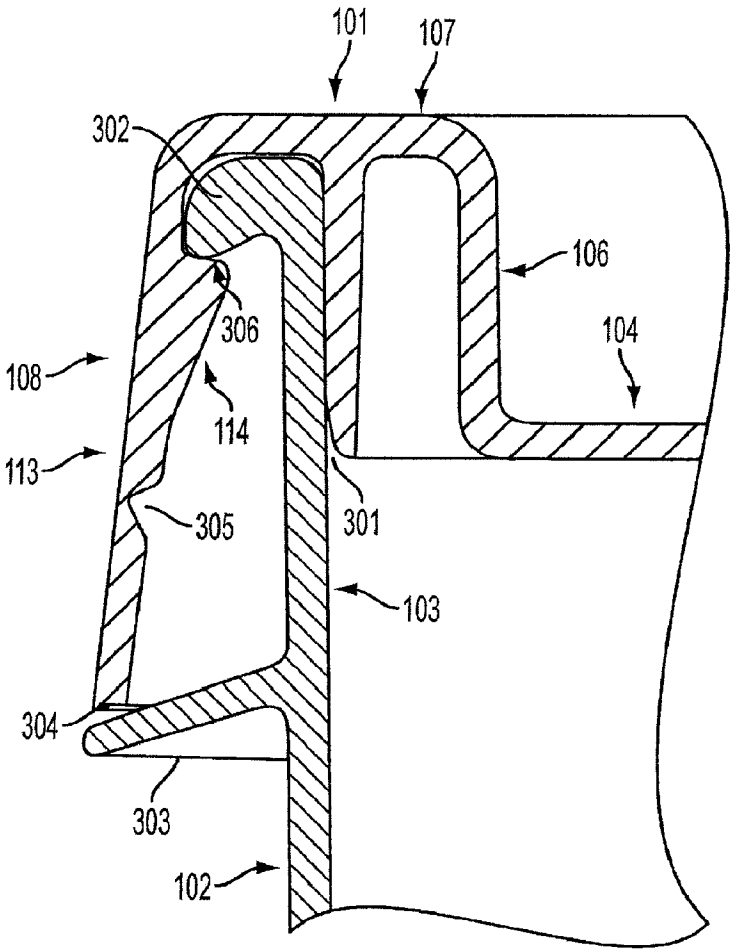
FIG. 3 shows a sectional view of a cover and container taken on the broken line 3-3 of FIG. 1.

Formed integrally with the upper extremity 103, in accordance with one embodiment, is a container retaining element 302 in the form of a cylindrically generated bead, as shown in FIGS. 3 and 4. The shape of the container retaining element is changed in various other embodiments. The container retaining element 302 extends completely around the perimeter of the extreme upper end of the upper extremity 103 of the container 102 (e.g. for ease of injection molding). In some embodiments, the container retaining element 302 is provided in segments such that the container retaining element 302 extends substantially around the container or only partially around the container. Spaced downwardly from the container retaining element 302 on the exterior of the upper extremity 103 of the container 102 is a right angularly projecting flange 303 upon the upper surface of which impinges the lower edge 304 of the skirt 108.

Figure 5:
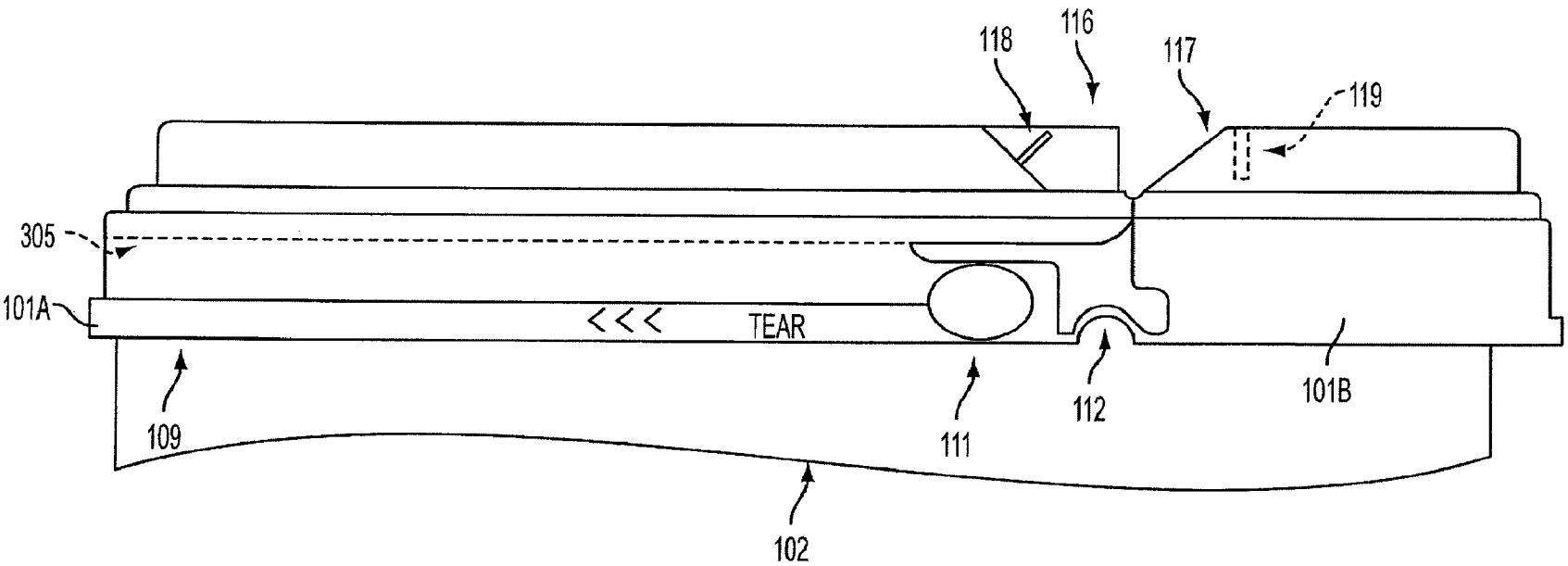
FIG. 5 illustrates a cover comprising a removable skirt with a tear strip, a male fastening component on a front portion of the cover, and a female fastening component on a back portion of the cover in accordance with one embodiment.

Referring to FIGS. 1 and 2, incorporated in the skirt 108 is a removable skirt portion 109. The removable skirt portion 109 may be initially fabricated integrally with the cover 101 but being defined at its upper extremity by a removal score line 305, as shown in FIGS. 3, 4, and 5. As shown in FIGS. 1, 2, and 4, incorporated on the inner surface of the removable skirt portion 109 adjacent to the removal score line 305 are removable primary detents 110 having a wedge-shaped portion with lands 401 formed upon the upper surfaces thereof engageable with the corresponding portions of the container retaining element 302.

When the removable skirt portion 109 is in the initial condition on the container 102, as shown in FIGS. 4 and 5, the removable primary detent 110 engages the underside of the container retaining element 302 and provides for securement of the cover 101 in operative relationship with the upper extremity 103 of the container 102. Having a removable skirt portion 109 allows for the cover to be securely fastened to the container during transportation and before the initial use of the container. After removal of the removable skirt portion 109, the lid is easily opened and closed as described herein. In some embodiments, a tear strip is not utilized and the lid does not incorporate the removable primary detent 110. The removable primary detent 110 is either not present or is not removable in alternative embodiments.

In one embodiment, a ring pull 111 is formed integrally with the removable skirt portion 109 and is connected by a frangible link 112 to the opposite extremity of the tear strip, as shown in FIG. 5. The removal score line 305 provides facile removal of the removable skirt portion 109. Therefore, the ring pull 111 allows for grasping in a conventional manner to remove the removable skirt portion 109 and, simultaneously, disengaging the removable primary detent 110 from operative engagement with cover retaining means 302.

The cover 101 further includes a tab member 113 peripherally spaced from the corners of the cover 101, as shown in FIGS. 1, 2, and 3. Mounted within the tab member is a secondary detent 114 having a wedge-shaped portion with lands 306 engageable with the container retaining element 302. The perimeters of the tab member 113 are defined by the upper score line 305. As the removable skirt portion 109 is stripped or removed from operative engagement with the skirt, the score line 305 permits the tab member 113 to remain integral with the cover 101, as shown in FIGS. 1 and 2.

Consequently, after the removable skirt portion 109 has been removed from its connection to the skirt 108, as graphically illustrated in FIGS. 1 and 2, the removal being accompanied by the corresponding removal of the removable primary detent 110, the secondary detent 114 remains engaged with the container retaining element 302 of the container. In addition to the secondary detent 114, the back cover detent 115 on the interior portion of the skirt 108 also remains engaged to the container retaining element 302. In this embodiment, the back cover portion skirt 108 is not removable.

In the embodiment of the invention shown in FIGS. 1 and 2, one tab member 113 is provided in the skirt 108, but it will be obvious to those skilled in the art that any number of tab members 113 can be provided. In the embodiment of the invention shown in FIGS. 1 and 2, however, the one tab member 113 having the secondary detent 114 in combination with the back cover detent 115 suffice to maintain the cover 101 in operative relationship with the container 102 after the removal of the primary detent means on the removable skirt portion 109.

However, the removal of the front cover portion 101A from operative engagement with the container 102 is easily facilitated because the engagement of the tab member 113 with the container retaining element 302 can be readily dislodged by gripping the tab member 113 and releasing it from operative engagement with the container retaining element 302. Thus, secondary detent means 114 is disengaged from the container retaining element 302 by lifting the cover up thereby dislodging the corresponding tab member 113 from its engagement with the container 102.

The cover of FIGS. 1, 2, 5, and 6 further includes a first fastening component 116 mounted on the front cover portion 101A and a second fastening component 117 mounted on the back cover portion 101B. The first fastening component 116 and the second fastening component 117 are positioned adjacent to the pivot score line 105, and are integral to the horizontal flange 107.

Subsequent to removal of the front cover portion 101A from operative engagement with the container 102, the front cover portion 101A may be pivoted (e.g. folded by lifting), as shown in FIG. 6. The front cover portion 101A will pivot along the pivot score line 105, thereby exposing an open portion 601 of the container 102. When the front cover portion 101A is sufficiently pivoted, the first fastening component 116 engages with the second fastening component 117. In an embodiment, illustrated in FIGS. 1, 5, and 6, the first fastening component 116 includes a tongue 118 and the second fastening component 117 includes a groove 119. In another embodiment, illustrated in FIG. 2, the first fastening component 116 includes a groove 119 and the second fastening component 117 includes a tongue 118. The tongue 118 securely fastens into the groove 119 upon pivoting the cover at the pivot score line 105, thereby holding the front cover portion 101A in place and allowing access to the contents of the container through the open portion 601 of the container 102. Thus, the front cover portion 101A is positioned and held at a fixed angle θ relative to the back cover portion 101B. As shown in FIG. 6, the fixed angle θ is less than 90 degrees. Other types of fastening components are utilized in other embodiments. Additionally, the placement of the fastening components on top of the lid is altered in other embodiments such that the fastening components are not formed integrally with the vertical wall 106, horizontal flange 107.

The tongue 118 may be disengaged from the groove 119 by pulling downward on the front cover portion. Re-engagement (e.g. snapping into place) of the secondary detent 114 with the container retaining element 302 results in a fully closed cover, thereby completely overlaying the open portion of the container 102 with the cover 101. Thus, the product within the container 102 is protected from atmospheric elements.

When it is desired to replace the cover 101 on the container 102, it can be readily accomplished by application of upward force to the front cover portion 101A and the back cover portion 101B causing disengagement of the secondary detent 114 and the back cover portion detent 115.

While the invention herein disclosed has been described by means of specific embodiments and applications thereof, other modifications, variations, and arrangements of the present invention may be made in accordance with the above teachings other than as specifically described to practice the invention within the spirit and scope defined by the following claims.

What is claimed is:

1. A cover for a container comprising:

a centrally located web;

an internal skirt configured to extend around the centrally located web;

an external skirt configured to extend around the centrally located web and the internal skirt;

a removable primary detent on an inner surface of the external skirt, said primary detent being engageable with a container retaining element present on said container, wherein the inner surface faces toward the centrally located web;

a secondary detent on the inner surface of the external skirt, said secondary detent engageable with a container retaining element present on said container, wherein the inner surface faces toward the centrally located web;

a pivot score line transversing said cover thereby defining a front cover portion and a back cover portion, said pivot score line pivotally connecting said front cover portion and said back cover portion;

the front cover portion including a first protruding region having a height higher than an upper surface of the external skirt and the back cover portion including a second protruding region having a height higher than the upper surface of the external skirt, wherein the centrally located web has a height less than the first protruding region and the second protruding region; and a fastening device comprising a first fastening component and a second fastening component, the first protruding region including the first fastening component and the second protruding region including the second fastening component wherein said first fastening component engages said second fastening component upon pivoting said cover at said pivot score line.

2. The cover of claim 1, wherein said first fastening component and said second fastening component are positioned adjacent to said pivot score line.

3. The cover of claim 1, wherein said first fastening component and said second fastening component form a male-female complementary fastening pair.

4. The cover of claim 1 comprising four corners.

5. The cover of claim 4, wherein said cover comprises substantially straight sides between each of said four corners.

6. The cover of claim 5, wherein said secondary detent is peripherally spaced from one of said corners.

7. The cover of claim 6, further comprising a tab member peripherally spaced from one of said corners, said secondary detent mounted within said tab member.

8. The cover of claim 1, comprising a plurality of secondary detents.

9. The cover of claim 1 composed of a rigid plastic.

10. The cover of claim 1 composed of polypropylene.

11. The cover of claim 1 composed of polypropylene impact copolymer.

12. The cover of claim 1 in combination with said container.

13. A container and cover assembly, comprising:

a container having an opening at an upper extremity thereof, the opening providing access to an inside of the container;

front and back cover portions pivotably connected to each other;

an external skirt of the cover configured to extend around the upper extremity of the container, the external skirt including a front skirt portion at a periphery of the front cover portion and a back skirt portion at a periphery of the back cover portion and having an upper surface height;

a central surface region;

a container retaining element extending along an outer surface of the upper extremity of the container, the outer surface facing away from the inside of the container;

one or more detents on an inner surface of the external skirt configured to engage the container retaining element, wherein the inner surface faces towards the inside of the container;

the front cover portion including a front protruding region between the front skirt portion and the central surface region and having a height higher than the upper surface height and the back cover portion including a back protruding region between the back skirt portion and the central surface region and having a height higher than the upper surface height, wherein a surface of the central surface region is less than the height of the front protruding region and the back protruding region; and a fastening device including a front fastening component and a back fastening component, the first protruding region including the front fastening component and the second protruding region including the back fastening component wherein the front fastening component is configured to engage the back fastening component upon pivoting of the front cover portion toward the back cover portion and the back fastening component and the front fastening component do not extend higher than the front protruding region and the back protruding region.

14. The container and cover of claim 13, wherein the front skirt portion of the external skirt includes a removal score line defining between a removable skirt portion and a remaining skirt portion.

15. The container and cover of claim 14, further comprising a projecting flange on an exterior of the container and spaced downwardly from the container retaining element, the projecting flange being configured to extend along a lower edge of the removable skirt portion of the front skirt portion of the external skirt.

16. The container and cover of claim 14, wherein the one or more detents include a primary front detent on an inner surface of the removable skirt portion configured to engage the container retaining element.

17. The container and cover of claim 14, wherein the one or more detents include a back detent on the inner surface of the back skirt portion configured to engage the container retaining element.

18. The container and cover of claim 14, wherein the remaining skirt portion of the front skirt portion of the external skirt includes a tab member at a periphery of the front cover portion.

19. The container and cover of claim 18, wherein the one or more detents include a secondary front detent on an inner surface of the tab member configured to engage the container retaining element.

20. A container and cover assembly, comprising:

a container having an opening for providing access to an inside of the container; and a cover having a centrally located web and having front and back cover portions, the front cover portion including a front protruding region having a height higher than the upper surface height and the back cover portion including a back protruding region having a height higher than the upper surface height; wherein the front cover portion pivots between an open position and a closed position, the cover including:

an external skirt configured to extend around an outside of the container, the external skirt including a front skirt portion at a periphery of the front cover portion and a back skirt portion at a periphery of the back cover portion, the front skirt portion of the external skirt including a removal score line defining between a removable skirt portion and a remaining skirt portion, wherein the back skirt portion and the front and back skirt portions of the front skirt portion are configured to extend around the outside of the container;

a primary front detent on an inner surface of the removable skirt portion for affixing the cover to the container before the removable skirt portion is removed, wherein the inner surface of the removable skirt portion faces the inside of the container;

a secondary front detent on an inner surface of the remaining skirt portion for affixing the cover to the container after the removable skirt portion is removed and when the front cover portion is in the closed position, wherein the inner surface of the remaining skirt portion faces the inside of the container;

a back detent on an inner surface of the back skirt portion for affixing the cover to the container when the front cover portion is in the open position; and a fastening device including a front fastening component and a back fastening component, the first protruding region including the front fastening component and the second protruding region including the back fastening component, wherein the front fastening component is configured to engage the back fastening component when the front cover is in the open position;

wherein the front protruding region is located between the centrally located web and the external skirt, the back protruding region is located between the centrally located web and the external skirt, wherein a height of the centrally located web is less than the height of the front protruding region and the back protruding region.

21. A cover for a container comprising:

a pivot score line transversing said cover thereby forming a front cover portion and a back cover portion, said pivot score line pivotally connecting said front cover portion and said back cover portion;

a primary detent connected to said cover, said primary detent being engageable with a container retaining element present on said container; and a secondary detent connected to said cover, said secondary detent engageable with a container retaining element present on said container;

characterized in that said primary detent is removable, in that the cover comprises a fastening device that comprises a male component mounted on said front cover portion and a female component mounted on said back cover portion, or a female component mounted on said front cover portion and a male component mounted on said back cover portion, said male component including a tongue and said female component including a groove, wherein said tongue securely fastens into said groove upon pivoting said cover at said pivot score line, and in that said male component and said female component, which have each a length and are each longer than wide, extend towards each other according to a same longitudinal direction that is transverse to the pivot score line, the length of the male component and the length of the female component being substantially parallel to the same longitudinal direction.

22. A cover for a container comprising:

a pivot score line transversing said cover thereby forming a front cover portion and a back cover portion, said pivot score line pivotally connecting said front cover portion and said back cover portion;

a primary detent connected to said cover, said primary detent being engageable with a container retaining element present on said container; and a secondary detent connected to said cover, said secondary detent engageable with a container retaining element present on said container;

characterized in that said primary detent is removable, in that the cover comprises a fastening device that comprises first fastening means and second fastening means, each of the first fastening means and the second fastening means being elongated according to a same longitudinal direction and having a tongue-like male component mounted on said front cover portion and a female component mounted on said back cover portion, or a female component mounted on said front cover portion and a tongue-like male component mounted on said back cover portion, said female component being provided with a slot in each of the first fastening means and the second fastening means, in that said male component further includes a tongue that protrudes in a direction lateral to said tongue-like male component and said female component further includes a groove that is lateral to said female component, wherein each of the tongue-like male components is received in the corresponding slot and said tongue securely fastens into said groove upon pivoting said cover at said pivot score line, and in that said male component and said female component have each a length and are each longer than wide, the length of the male component and the length of the female component being measured according to said longitudinal direction that is transverse to the pivot score line.

* * * * *